US010663180B2

(12) United States Patent
Sato et al.

(10) Patent No.: US 10,663,180 B2
(45) Date of Patent: May 26, 2020

(54) INDOOR UNIT FOR AIR-CONDITIONING APPARATUS

(71) Applicant: Mitsubishi Electric Corporation, Tokyo (JP)

(72) Inventors: Masakazu Sato, Tokyo (JP); Takuya Goto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 36 days.

(21) Appl. No.: 15/781,574

(22) PCT Filed: Feb. 8, 2016

(86) PCT No.: PCT/JP2016/053636
§ 371 (c)(1),
(2) Date: Jun. 5, 2018

(87) PCT Pub. No.: WO2017/138063
PCT Pub. Date: Aug. 17, 2017

(65) Prior Publication Data
US 2019/0113243 A1 Apr. 18, 2019

(51) Int. Cl.
*F24F 1/0059* (2019.01)
*F24F 1/0007* (2019.01)
(Continued)

(52) U.S. Cl.
CPC ..... *F24F 1/0059* (2013.01); *F24F 1/0007* (2013.01); *F24F 1/0025* (2013.01);
(Continued)

(58) Field of Classification Search
CPC ..... F24F 1/0059; F24F 1/0007; F24F 1/0025; F24F 1/0057; F24F 11/89; F24F 13/20; F24F 2110/10
(Continued)

(56) References Cited

U.S. PATENT DOCUMENTS

2010/0287973 A1* 11/2010 Son ..... F24F 1/0007 62/407

FOREIGN PATENT DOCUMENTS

| | | | |
|---|---|---|---|
| JP | 11-230601 A | | 8/1999 |
| JP | 11230601 A | * | 8/1999 |
| JP | 2012-112599 A | | 6/2012 |

OTHER PUBLICATIONS

International Search Report of the International Searching Authority dated May 10, 2016 for the corresponding International application No. PCT/JP2016/053636 (and English translation).
(Continued)

*Primary Examiner* — Steve S Tanenbuam
(74) *Attorney, Agent, or Firm* — Posz Law Group, PLC

(57) ABSTRACT

Provided is an indoor unit for an air-conditioning apparatus, which is capable of detecting a room temperature without impairing a design of the air-conditioning apparatus. The indoor unit for an air-conditioning apparatus according to the present invention includes: a housing having a rear surface mounted to a wall and having an air inlet and an air outlet formed therein; a heat exchanger and an air-sending device arranged on a main air passage extending from the air inlet to the air outlet; and a room temperature sensor configured to detect a temperature of an intake air. The housing has an air intake port from which air to be sent to the room temperature sensor is allowed to be taken, the air intake port being provided in a side surface adjacent to the rear surface. The room temperature sensor is arranged on an air passage connecting the air intake port and the main air passage. The air intake port is opened toward a rear surface side of the housing.

10 Claims, 14 Drawing Sheets

(51) Int. Cl.

| | |
|---|---|
| ***F24F 1/0025*** | (2019.01) |
| ***F24F 1/0057*** | (2019.01) |
| ***F24F 11/89*** | (2018.01) |
| ***F24F 13/20*** | (2006.01) |
| *F24F 110/10* | (2018.01) |

(52) U.S. Cl.
CPC ..... *F24F 1/0057* (2019.02); *F24F 11/89* (2018.01); *F24F 13/20* (2013.01); *F24F 2110/10* (2018.01)

(58) Field of Classification Search
USPC ..... 62/410
See application file for complete search history.

(56) References Cited

OTHER PUBLICATIONS

Office Action dated Apr. 29, 2019 issued in corresponding CN patent application No. 201680004008.2 (and English translation).

* cited by examiner

INDOOR UNIT FOR AIR-CONDITIONING APPARATUS

This application is a U.S. national stage application of PCT/JP2016/053636 filed on Feb. 8, 2016, the contents of which are incorporated herein by reference.

TECHNICAL FIELD

The present invention relates to an indoor unit for an air-conditioning apparatus, and more particularly, to the arrangement of a room temperature sensor.

BACKGROUND ART

A related-art indoor unit for an air-conditioning apparatus includes a room temperature sensor configured to measure a temperature of indoor air. In order to precisely detect a room temperature, the room temperature sensor is arranged at a position where the room temperature sensor is prevented from being thermally affected by a heat exchanger provided in the indoor unit. Thus, the room temperature sensor is arranged at one end portion of an interior of a housing of the indoor unit in its left and right directions, and a ventilation hole, through which the indoor air is introduced, is formed at a position corresponding to the room temperature sensor in the housing covering the one end thereof. During an operation of the air-conditioning apparatus, the room temperature sensor detects the temperature of the indoor air flowing thereinto through the ventilation hole. The detected temperature of the indoor air is used for air conditioning.

For example, according to an indoor unit for an air-conditioning apparatus disclosed in Patent Literature 1, an outside air communication port corresponding to a room temperature sensor is formed in a wall surface of a housing, and the room temperature sensor is arranged so as to be positioned in the vicinity of an inner side of the outside air communication port of the housing. Thus, the temperature sensor is exposed to outside air through the outside air communication port of the housing, thereby being capable of detecting an indoor temperature by the room temperature sensor without being affected by a heat exchanger.

CITATION LIST

Patent Literature

Patent Literature 1: Japanese Unexamined Patent Application Publication No. Hei 11-230601

SUMMARY OF INVENTION

Technical Problem

However, according to the disclosure of Patent Literature 1, a ventilation hole is opened in one side surface of the housing of the indoor unit for an air-conditioning apparatus. In order to precisely detect the temperature of the indoor air, sufficient amount of the air is required. Thus, an area of an opening of the ventilation hole is required. Further, the ventilation hole is exposed from a surface of the housing. Thus, the ventilation hole is required to be formed into a slit-like shape so that a fingertip of a user is prevented from entering the indoor unit through the ventilation hole. Further, in order to prevent an internal structure from being seen through the ventilation hole, the ventilation hole is required to be formed into a shape by which the internal structure is difficult to be visually recognized. However, there is a problem in that the number of slits of the ventilation hole is required to be large in order to increase the area of the opening of the ventilation hole. Further, there is a problem in that, when the number of slits is large, the ventilation hole is liable to be visually recognized from outer appearance, with the result that design of the indoor unit is impaired. Further, the ventilation hole is always caught by the eyes of the user, and the outer appearance of the indoor unit lacks bilateral symmetry. Thus, also in this regard, the design of the indoor unit is impaired. Moreover, there is a problem in that, when the indoor unit is installed so that the side surface having the ventilation hole formed therein is close to an indoor wall, the amount of the air to be introduced through the ventilation hole becomes smaller, with the result that the room temperature cannot precisely be detected.

The present invention has been made to solve the above-mentioned problems, and an object of the present invention is to provide an indoor unit for an air-conditioning apparatus, in which a room temperature sensor is arranged so as to be prevented from being thermally affected by a heat exchanger, and in which a ventilation hole is formed at a position where an amount of the air required for room temperature detection is secured, and where the ventilation hole is less liable to be visually recognized by the user from outside to prevent design of outer appearance from being impaired.

Solution to Problem

According to one embodiment of the present invention, there is provided an indoor unit for an air-conditioning apparatus, including: a housing having a rear surface mounted to a wall and having an air inlet and an air outlet formed therein; a heat exchanger and an air-sending device arranged on a main air passage extending from the air inlet to the air outlet; and a room temperature sensor configured to detect a temperature of an intake air, in which the housing has an air intake port from which air to be sent to the room temperature sensor is allowed to be taken, the air intake port being provided in a side surface adjacent to the rear surface, in which the room temperature sensor is arranged on an air passage connecting the air intake port and the main air passage, and in which the air intake port is opened toward a rear surface side of the housing.

Advantageous Effects of Invention

According to one embodiment of the present invention, during the operation of the air-conditioning apparatus, the room temperature sensor can precisely detect the temperature without being affected by the heat exchanger. Further, the ventilation hole is formed at the position where the ventilation hole is less liable to be visually recognized by the user. Thus, a large area of an opening can be secured, thereby being capable of sending a sufficient amount of the air required for the detection of the room temperature to the room temperature sensor. Further, even when the area of the opening is increased, the ventilation hole is less liable to be caught by eyes of the user. Thus, the internal structure of the indoor unit cannot be visually recognized, thereby being capable of forming the ventilation hole without impairing the design of the indoor unit.

DESCRIPTION OF EMBODIMENTS

Figure 1:
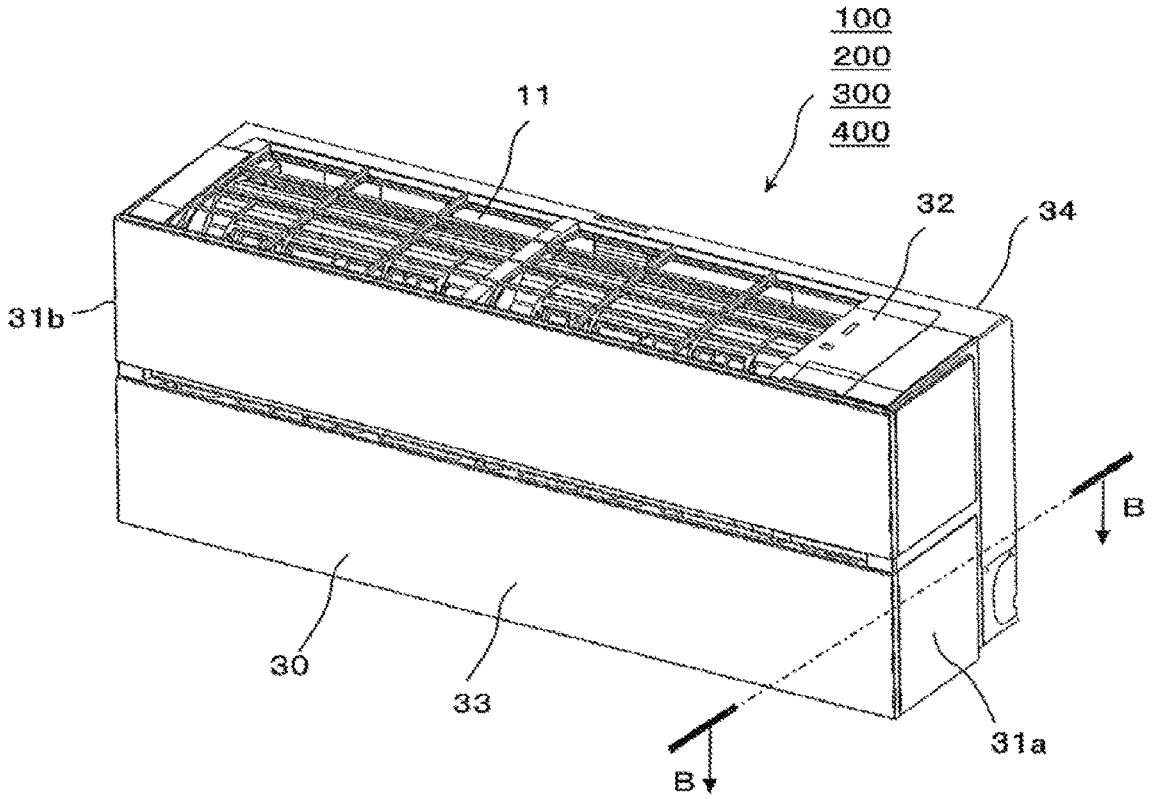
FIG. 1 is a perspective view for illustrating an outer appearance of an indoor unit for an air-conditioning apparatus according to Embodiment 1 of the present invention.

Now, with reference to the drawings, description is made of embodiments of the present invention. In the drawings, devices denoted by the same reference symbols are the same or corresponding devices, and the same applies hereinafter. Further, the modes of components described herein are merely illustrative, and the present invention is not limited to those described herein. In particular, combinations of the components are not limited to the combinations in the respective embodiments, and components described in one embodiment may be applied to another embodiment. Further, with regard to a plurality of devices of the same type which are distinguished by suffixes, in a case where the devices are not particularly required to be distinguished or specified, the suffixes are omitted in some cases. In addition, the relationship of sizes of the components in the drawings may differ from the actual sizes.

Embodiment 1

<Indoor Unit 100 for Air-Conditioning Apparatus>

FIG. 1 is a perspective view for illustrating an outer appearance of an indoor unit 100 for an air-conditioning apparatus according to Embodiment 1 of the present invention. As illustrated in FIG. 1, in the indoor unit 100, an air inlet 11 is formed in an upper surface of a housing 30 having a rectangular parallelepiped shape, and an air outlet 12 is formed in a lower surface of the housing 30. A front surface of the housing 30 is covered with a front panel 33. Further, with regard to side surfaces of the housing 30, a side surface on the right side as viewed from the front is covered with a side panel 31*a*, and a side surface on the left side as viewed from the front is covered with a side panel 31*b*. An upper surface of the housing 30 is covered with an upper panel 32. Openings are formed in the upper panel 32, and serve as the air inlet 11. A rear casing 34 is arranged on a rear surface side of the housing 30. The indoor unit 100 is installed by fixing the rear casing 34 to an indoor wall surface.

<Structure of Housing 30 Constructing Indoor Unit 100>

Figure 2:
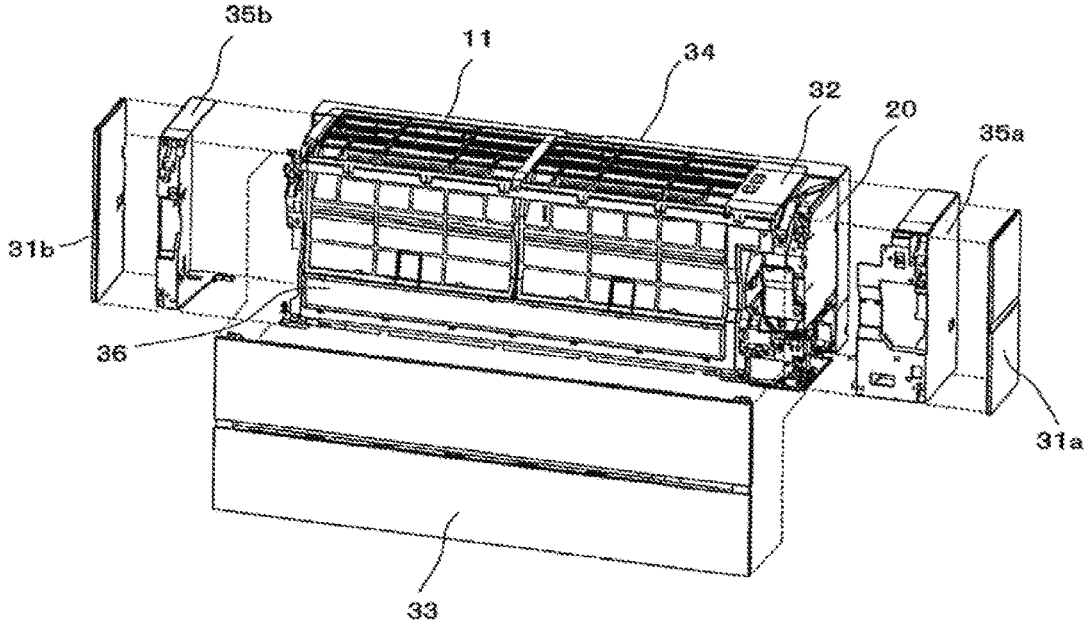
FIG. 2 is an exploded perspective view for illustrating the indoor unit for an air-conditioning apparatus of FIG. 1.

FIG. 2 is an exploded perspective view for illustrating the indoor unit 100 for an air-conditioning apparatus of FIG. 1. FIG. 2 is a view for illustrating the indoor unit 100 under a state in which the front panel 33 and the side panels 31 among the components of the housing 30 are removed, and a housing side portion 35*a* being an internal structure of a side surface on the right side of the housing 30 and a housing side portion 35*b* being an internal structure of a side surface on the left side of the housing 30 are further removed. A housing front portion 36 is arranged on a front surface side from which the front panel 33 is removed. An electric component box 20, which accommodates a control device configured to control the indoor unit 100, is arranged on the side surface on the right side of the housing front portion 36. Respective components constructing the housing 30 may integrally be constructed with the plurality of components. For example, the upper panel 32 and the housing front portion 36 may be integrated into one component.

<Internal Structure of Indoor Unit 100>

Figure 3:
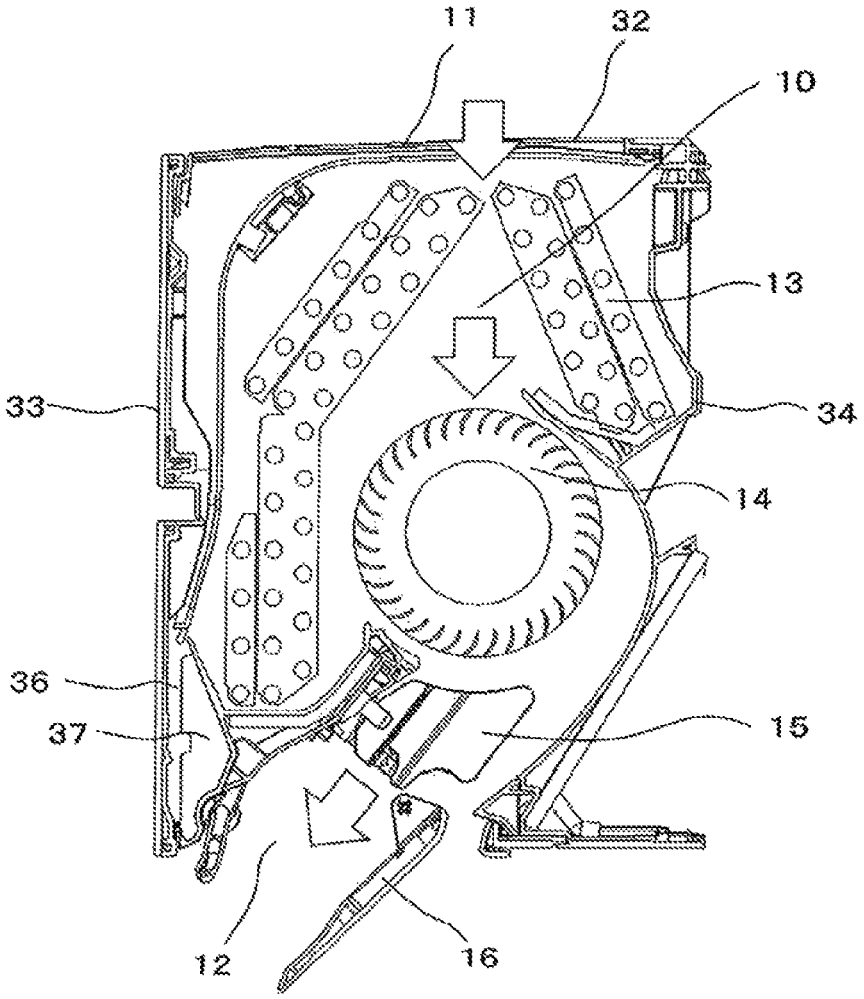
FIG. 3 is a sectional view for illustrating the indoor unit for an air-conditioning apparatus of FIG. 1.

FIG. 3 is a sectional view for illustrating the indoor unit 100 for an air-conditioning apparatus of FIG. 1. FIG. 3 is a view for illustrating a cross section of the indoor unit 100 as viewed from the right side of the housing 30. As illustrated in FIG. 3, between the air inlet 11 formed in the upper surface of the housing 30 and the air outlet 12, a main air passage 10 is formed through arrangement of the housing front portion 36 on the front surface side and the rear casing 34 on the rear surface side. Further, the air outlet 12 is formed in a housing bottom portion 37 positioned below the housing front portion 36. The housing bottom portion 37 also forms the main air passage 10 in a periphery of the air outlet 12. A horizontal vane 15 is arranged inside the air outlet 12 to adjust a horizontal airflow. A vertical vane 16 is arranged at an opening portion of the air outlet 12 so that the vertical vane 16 can open and close the air outlet 12 to adjust a vertical airflow. A heat exchanger 13 is arranged on upstream of the main air passage 10, that is, on the air inlet 11 side. An air-sending device 14 is arranged downstream of the heat exchanger 13. The heat exchanger 13 corresponds to a heat exchanger of the present invention, and the air-sending device 14 corresponds to an air-sending device of the present invention. The heat exchanger 13 is arranged so as to surround the air-sending device 14 from an upper side to a front surface side thereof. When the air-sending device 14 generates airflow through driving of a motor (not shown), the air taken in through the air inlet 11 passes through the heat exchanger 13, and is sent to the air outlet 12. The heat exchanger 13 causes heat exchange to be performed between a refrigerant flowing through pipes inside the heat exchanger and the indoor air supplied from the air-sending device 14. In Embodiment 1, a cross-flow fan is employed as the air-sending device 14. However, the air-sending device 14 is not limited thereto.

<Structure of Side Surface Side of Indoor Unit 100 and Arrangement of Room Temperature Sensor 50>

Figure 4:
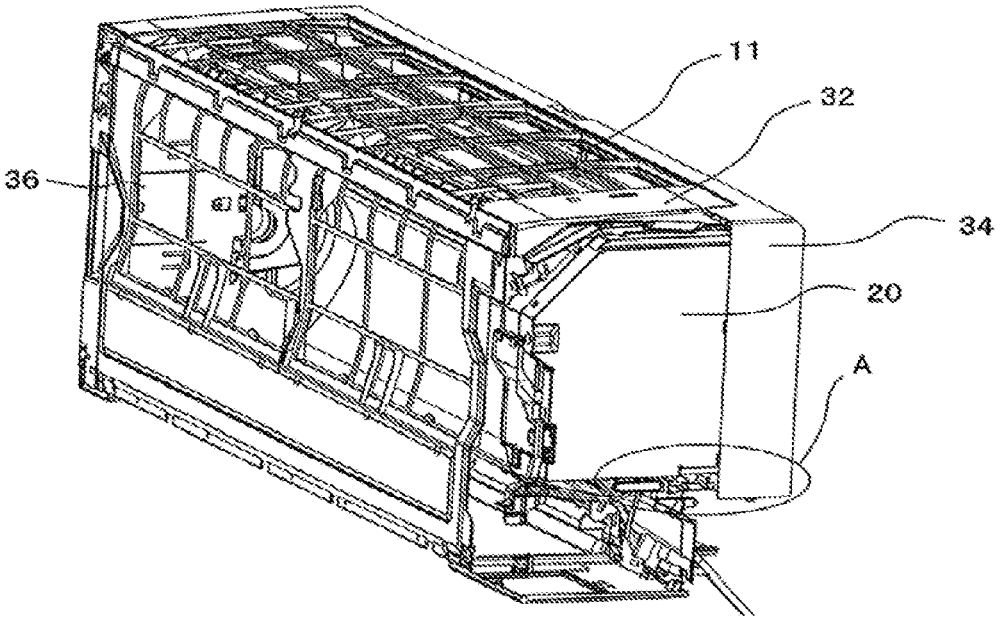
FIG. 4 is a view for illustrating the indoor unit for an air-conditioning apparatus of FIG. 1 under a state in which a front panel and a housing side portion on the right side are removed.
Figure 5:
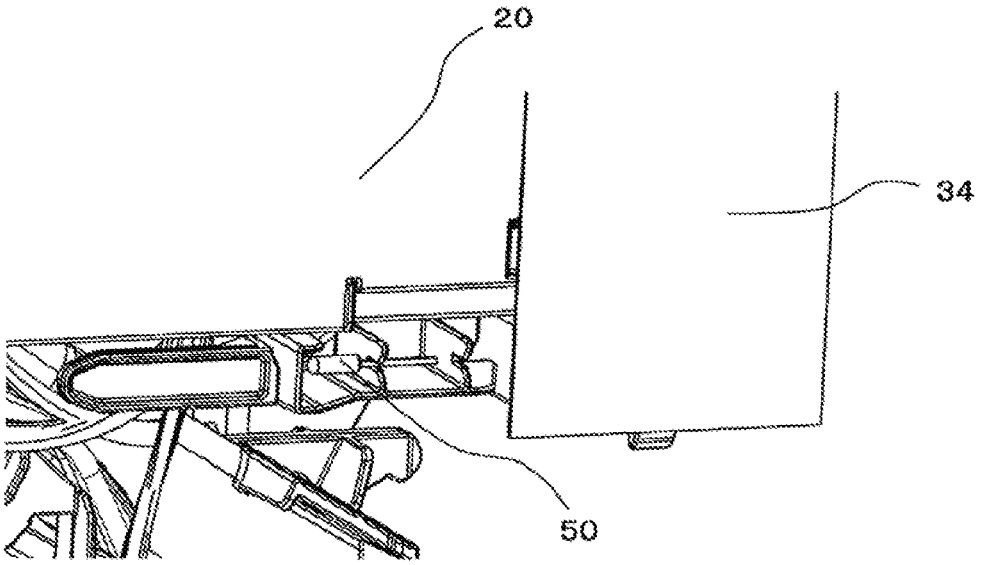
FIG. 5 is an enlarged view for illustrating a periphery of a room temperature sensor of FIG. 4.

FIG. 4 is a view for illustrating the indoor unit 100 for an air-conditioning apparatus of FIG. 1 under a state in which the front panel 33 and the housing side portion 35*a* on the right side are removed. FIG. 5 is an enlarged view for illustrating a periphery of a room temperature sensor 50 of FIG. 4. An enlarged view of a room temperature sensor peripheral portion A of FIG. 4 corresponds to FIG. 5. In FIG. 4 and FIG. 5, the room temperature sensor 50, which is configured to detect the indoor temperature, is mounted to a bottom of the electric component box 20. This room temperature sensor 50 is arranged on an inner side of the housing side portion 35*a*. The room temperature sensor 50 is constructed by, for example, a thermistor.

The room temperature sensor 50 is not arranged adjacent to the heat exchanger 13. With this structure, the room temperature sensor 50 is prevented from being thermally affected by the heat exchanger 13. Accordingly, the room temperature sensor 50 can precisely detect the room temperature. Further, the room temperature sensor 50 is arranged at a location close to the electric component box 20 below the electric component box 20. The room temperature, which is detected by the room temperature sensor 50, is used for air conditioning. Thus, the room temperature sensor 50 is connected to the control device (not shown) in the electric component box 20 through wiring. In order to shorten the wiring between the room temperature sensor 50 and the control device, it is desired that the room temperature sensor 50 be arranged in the vicinity of the electric component box 20. Further, during an operation of the air-conditioning apparatus, air conditioning is performed, with the result that heat is generated in the control device. Thus, the heat is generated also in the electric component box 20 during the operation of the air-conditioning apparatus. The heat, which is generated in the electric component box 20, is liable to be transferred in an upward direction. Thus, it is desired that the room temperature sensor 50 be arranged below the electric component box 20. However, as long as the electric component box 20 can be prevented from being thermally affected, the arrangement of the room temperature sensor 50 is not limited to the above-mentioned arrangement.

Figure 6:
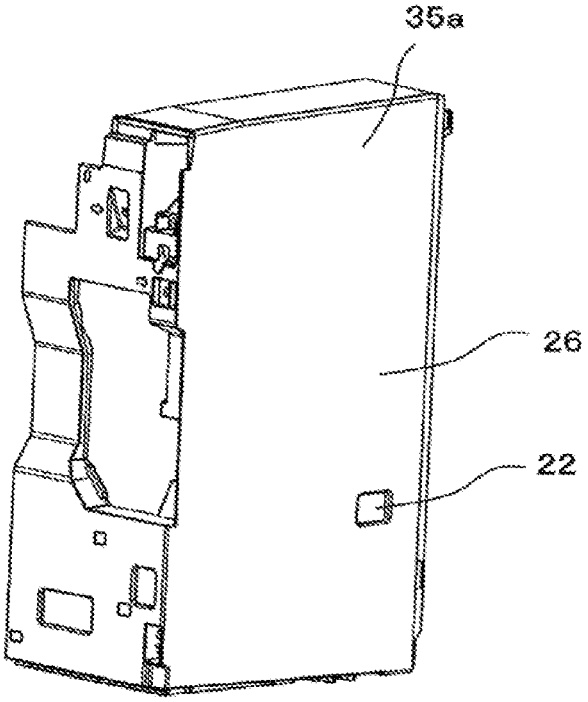
FIG. 6 is a perspective view for illustrating the housing side portion of the indoor unit for an air-conditioning apparatus according to Embodiment 1 of the present invention.

FIG. 6 is a perspective view for illustrating the housing side portion 35*a* of the indoor unit 100 for an air-conditioning apparatus according to Embodiment 1 of the present invention. As illustrated in FIG. 6, a ventilation hole 22, which corresponds to a position of the room temperature sensor 50 arranged inside the housing 30, is formed in the housing side portion 35*a*. The room temperature sensor 50 is positioned on an inner side of the ventilation hole 22 of the housing side portion 35*a*. The room temperature sensor 50 is arranged at a position inside the housing 30 and as close as possible to an indoor space so as to detect the room temperature with higher accuracy. In Embodiment 1, the room temperature sensor 50 is arranged on an immediate back side of a surface 26 of the housing side portion 35*a* in FIG. 6, and arranged inside the ventilation hole 22. The ventilation hole 22 is opened toward a side surface side of the indoor unit 100 and is covered with the side panel 31*a*.

<Structures of Side Panel 31*a* and Housing Side Portion 35*a*>

Figure 7:
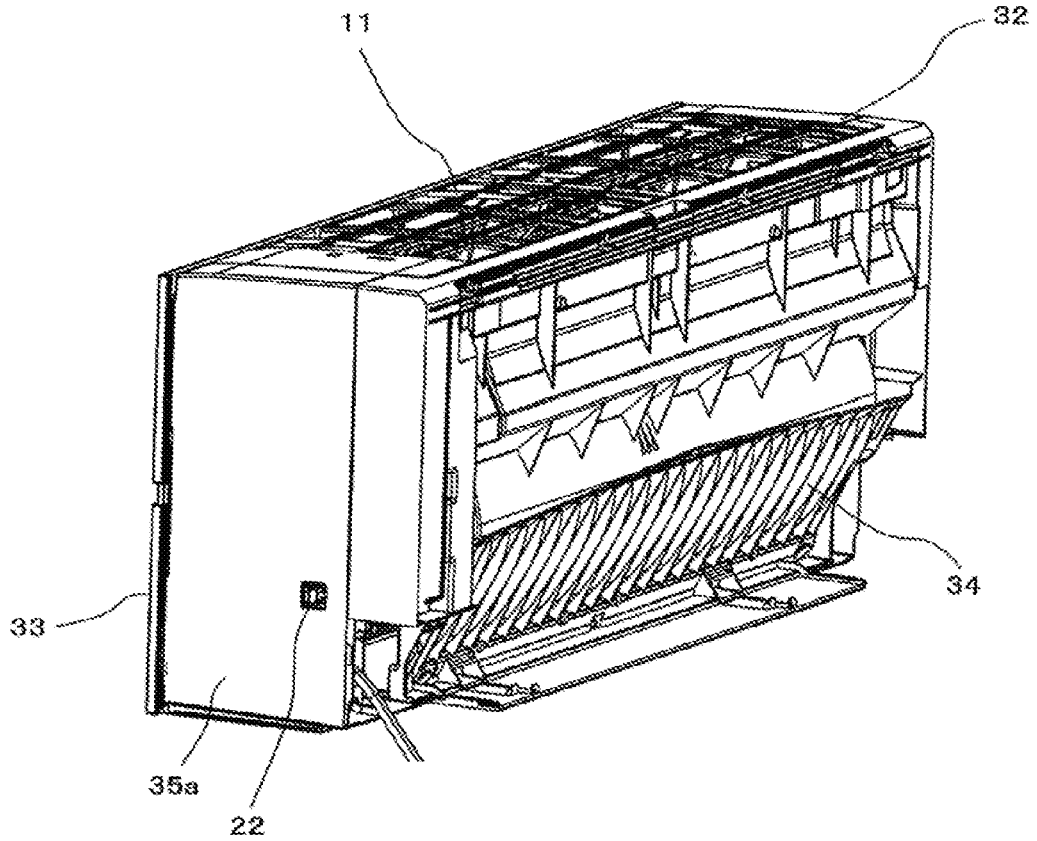
FIG. 7 is a view for illustrating the indoor unit of FIG. 1 under a state in which a side panel is removed.

FIG. 7 is a view for illustrating the indoor unit 100 of FIG. 1 under a state in which the side panel 31*a* is removed. FIG. 7 is a view for illustrating a right side of the indoor unit 100 as viewed from the front. As illustrated in FIG. 6 and FIG. 7, the ventilation hole 22, which corresponds to the room temperature sensor 50, is formed in the housing side portion 35*a* on the right side as viewed from the front of the indoor unit 100.

As illustrated in FIG. 2, the side panel 31*a* is mounted so as to cover the housing side portion 35*a* having the ventilation hole 22. With this structure, the ventilation hole 22 is not exposed from the surface of the indoor unit 100 at the side surface on the right side of the indoor unit 100 of FIG. 1 as viewed from the front, and the hole cannot be seen on an outer appearance surface under a state in which the indoor unit 100 is installed. Thus, the ventilation hole 22 does not affect design of the indoor unit 100. Further, the ventilation hole 22 is covered with the side panel 31*a* and does not affect the design of the indoor unit 100. Thus, the area of an opening of the ventilation hole 22 can be increased within a range of dimensions of the side panel 31*a*.

Figure 8:
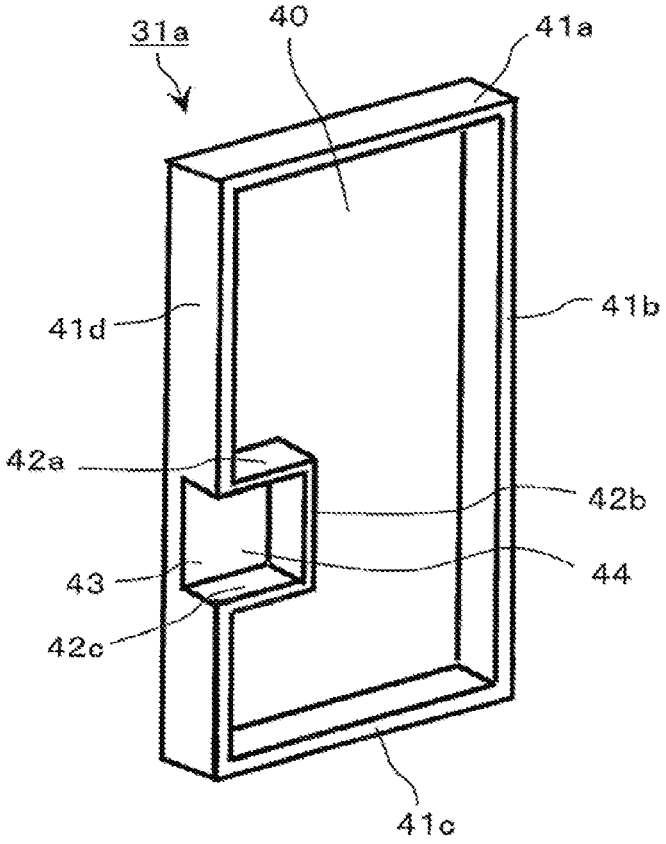
FIG. 8 is a perspective view for illustrating a side panel on the right side of the indoor unit of FIG. 1 as viewed from a back side.

FIG. 8 is a perspective view for illustrating the side panel 31*a* on the right side of the indoor unit 100 of FIG. 1 as viewed from a back side. Specifically, FIG. 8 is a perspective view for illustrating the side panel 31*a* as viewed from an inside of the indoor unit 100 toward an outside of the indoor unit 100. The side panel 31*a* has a flat plate-shaped base portion 40, and outer peripheral walls 41*a* to 41*d* extending upright from an outer edge portion of the base portion 40 in a normal direction of the base portion 40. That is, the side panel 31*a* is not merely a flat plate, but has a box-shaped structure formed by removing an unnecessary thick portion thereinside. Through formation of the side panel 31*a* with such a hollow structure, cost for material to be used can be reduced, and a thickness of the side panel 31*a* can be uniform, with the result that moldability is improved. In the side panel 31*a*, the outer peripheral wall 41*b* is on the front surface side of the indoor unit 100, and the outer peripheral wall 41*d* is on a rear surface side of the indoor unit 100. Further, the outer peripheral wall 41*a* is on a top surface side of the indoor unit 100, and the outer peripheral wall 41*c* is on a bottom surface side.

A part of the outer peripheral wall 41*d* is cut out into a rectangular shape to serve as an air intake port 43. In an inner direction from the outer edge portion of the base portion 40 toward an inner side of the base portion 40, a flow passage wall 42*a* and a flow passage wall 42*c* extend from the air intake port 43. At end portions to which the flow passage wall 42*a* and the flow passage wall 42*c* extend, a flow passage wall 42*b* is arranged so as to connect the flow passage wall 42*a* and the flow passage wall 42*c*. That is, the flow passage walls 42*a* to 42*c* form a bag-shaped wall with the air intake port 43 as an inlet side.

<With Regard to Airflow Passage for Temperature Detection>

Figure 9:
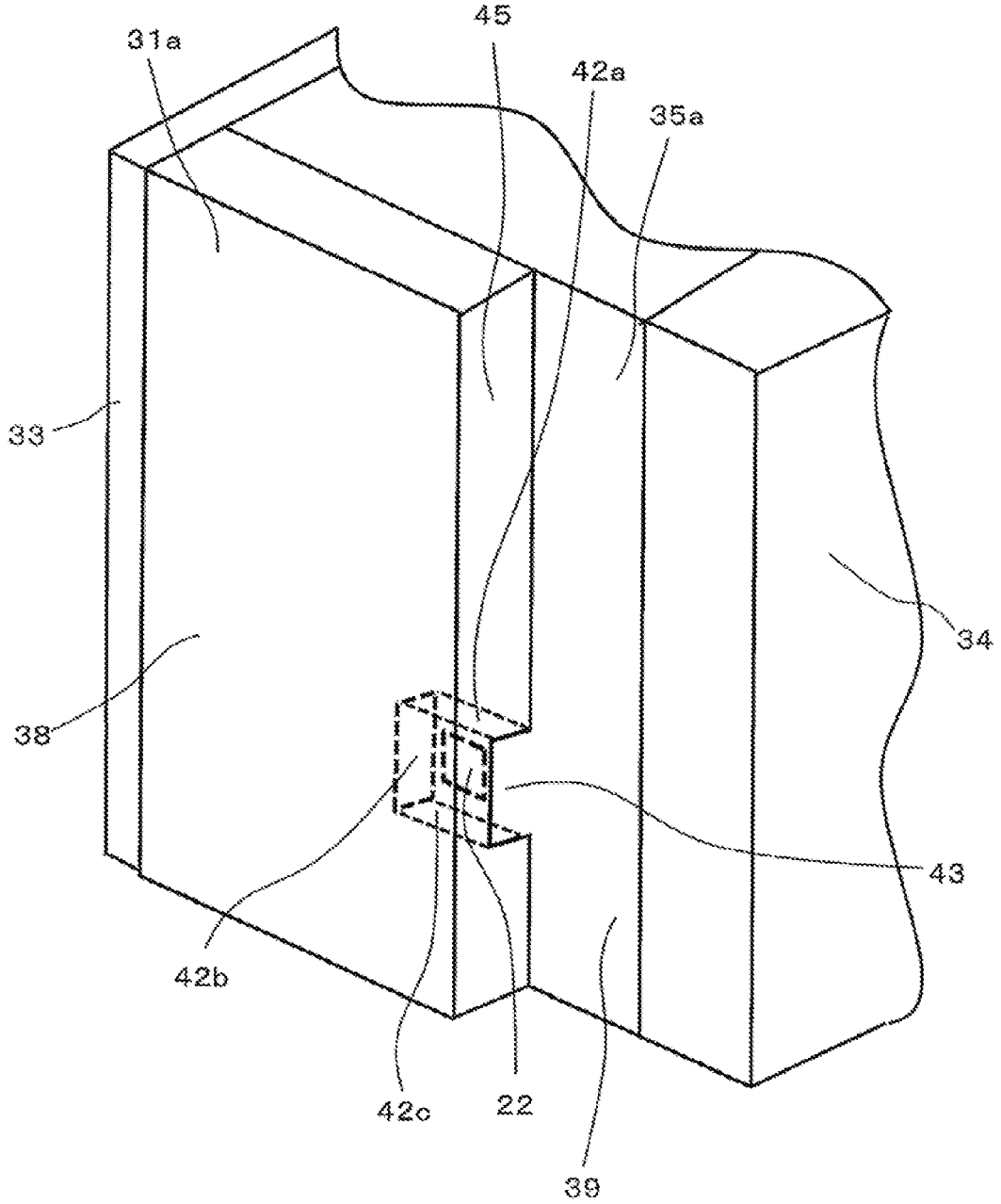
FIG. 9 is a schematic view for illustrating a side surface on the right side of the indoor unit of FIG. 1 as viewed from above on the rear surface side.

FIG. 9 is a schematic view for illustrating a side surface on the right side of the indoor unit 100 of FIG. 1 as viewed from above on the rear surface side. As illustrated in FIG. 9, the side surface of the housing 30 has a first surface 38 positioned on an outer side of the housing 30, and a second surface 39 positioned away from the first surface 38 in an inner direction of the housing. A stepped surface 45, which is perpendicular to the first surface 38 and the second surface, is formed between the first surface 38 and the second surface 39. The first surface 38 is a part of the side panel 31*a*. In Embodiment 1, the second surface 39 is formed of the housing side portion 35*a* and the rear casing 34. The stepped surface 45 is oriented rearward of the housing 30. The stepped surface 45 has a recessed portion which is opened toward the rear surface side, and the opening portion of the recessed portion serves as the air intake port 43. Inside the recessed portion, a hole is opened toward an inner side of the housing 30, and the hole serves as the ventilation hole 22.

Figure 10:
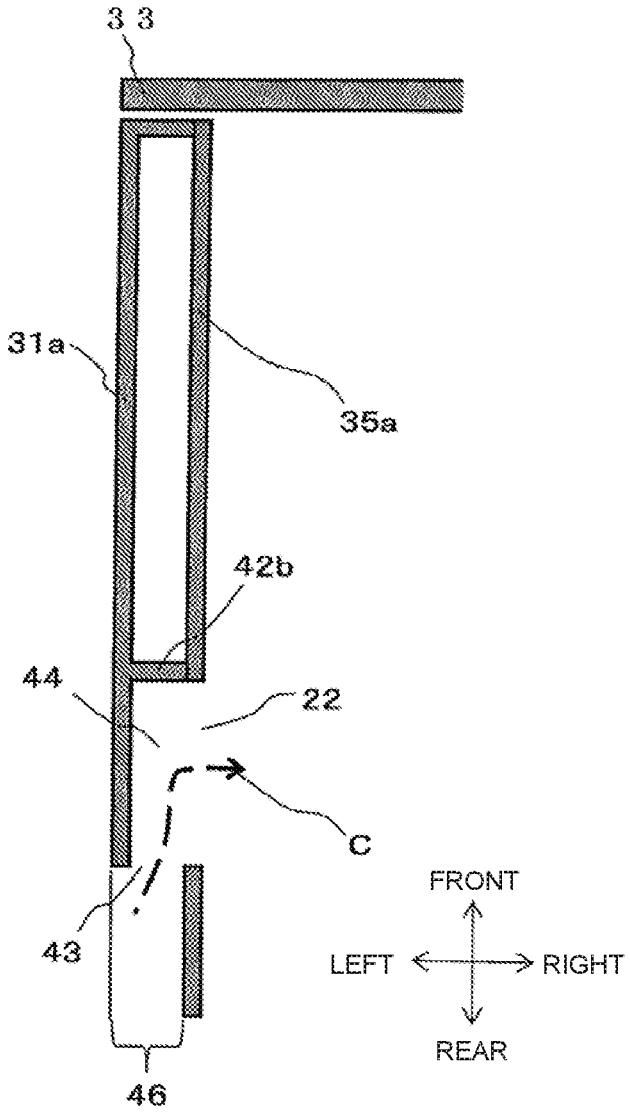
FIG. 10 is a sectional view for illustrating the indoor unit according to Embodiment 1 of the present invention taken along the line B-B of FIG. 1.

FIG. 10 is a sectional view for illustrating the indoor unit 100 according to Embodiment 1 of the present invention taken along the line B-B of FIG. 1. FIG. 10 is a view for illustrating the side panel 31*a*, the housing side portion 35*a*, and the front panel 33 of the housing 30 of the indoor unit 100 by a cross section including the air intake port 43 and the ventilation hole 22. As illustrated in FIG. 9, the side panel 31*a* and the housing side portion 35*a* are mounted to each other under a state of being held in contact and being overlapped with each other. In this manner, the side panel 31*a* and the housing side portion 35*a* form a step 46. The step 46 is formed so that the rear surface side of the indoor unit 100 serves as the stepped surface 45. The air intake port 43 is formed in the stepped surface 45 and opened. The stepped surface 45 of the step 46 is formed so as to be away from a rear surface of the housing 30, which is mounted to an indoor wall, on the front surface side of the housing 30 by a predetermined distance. When the stepped surface 45 is formed excessively close to the rear surface of the housing 30, in a case where the indoor unit 100 is installed on the indoor wall, the air intake port 43 is close to the wall surface, with the result that an air intake amount may be reduced in some cases.

An airflow passage 44, which is surrounded by the flow passage walls 42*a* to 42*c*, is formed so as to cover the ventilation hole 22 formed in the housing side portion 35*a* from the side surface side. The flow passage walls 42*a* to 42*c* forming the airflow passage 44 are arranged so as to surround a periphery of the opening of the ventilation hole 22 from three directions. The flow passage walls 42*a* to 42*c* are opened toward the rear surface side of the housing 30. Further, the flow passage walls 42*a* to 42*c* are mounted under a state of being held in contact with a surface in which the ventilation hole 22 of the housing side portion 35*a* is opened. With this structure, in the airflow passage 44 from the air intake port 43 to the ventilation hole 22, an opening larger than the ventilation hole 22 is not present. Thus, the air having blown in through the air intake port 43 by rotation of the air-sending device 14, stagnates in the airflow passage 44 to be introduced to the ventilation hole 22. That is, a passage from the air intake port 43 to the ventilation hole 22 via the airflow passage 44 is formed between the side panel 31*a* and the housing side portion 35*a*. As indicated by the airflow C of FIG. 10, the air in a room where the indoor unit 100 for an air-conditioning apparatus is installed, is caused to flow into the housing 30. In FIG. 9, the flow passage walls 42*a* to 42*c* form the rectangular shape to surround the ventilation hole 22. However, the flow passage walls 42*a* to 42*c* may form, for example, a U-shape, that is, may form a triangular shape by two walls to surround the ventilation hole 22.

Further, as illustrated in FIG. 10, in Embodiment 1, an opening direction of the air intake port 43 is perpendicular to an opening direction of the ventilation hole 22. That is, the ventilation hole 22 is opened in a direction perpendicular to the side surface of the indoor unit 100, and hence the air intake port 43 is opened in a rear direction of the indoor unit 100. The room temperature sensor 50 is arranged on a far side of the ventilation hole 22. The ventilation hole 22 is not limited to a mode of being opened in the direction perpendicular to the side surface of the indoor unit 100. The ventilation hole 22 only needs to have the flow passage walls 42 therearound to form the airflow passage 44 so that the air can be introduced to the room temperature sensor 50.

Further, the air intake port 43 is formed so as to be oriented toward the rear surface side of the indoor unit 100. With this structure, the air intake port 43 cannot be seen from the directions of the front surface, the bottom surface, and the side surface of the indoor unit 100, with the result that the air intake port 43 does not affect the outer appearance of the indoor unit 100. In this manner, the design of the indoor unit 100 can be improved.

Moreover, the step 46, which is formed of the side panel 31*a* and the housing side portion 35*a*, is formed away from the rear surface of the indoor unit 100 on the front surface side by the predetermined distance. Further, the air intake port 43 formed in the step 46 is oriented toward the rear surface side of the indoor unit 100. Thus, even when the indoor unit 100 is installed in the room under a state in which the side surface on the right side of the indoor unit 100 is close to the wall surface, the air intake port 43 is not blocked by the wall surface. Thus, airflow into the air intake port 43 can be secured.

The air intake port 43 is opened toward the rear surface of the indoor unit 100. The ventilation hole 22 is opened toward the side surface side of the indoor unit 100 and is covered with the side panel 31*a*. With such structure, the air intake port 43 and the ventilation hole 22 cannot be seen from the side surface side. Therefore, an area of an opening of the air intake port 43 and an area of an opening of the ventilation hole 22 can be increased. Accordingly, an airflow rate to the room temperature sensor 50 can freely be increased, thereby being capable of improving the accuracy of the room temperature detection of the room temperature sensor 50.

<Airflow for Room Temperature Detection>

Figure 11:
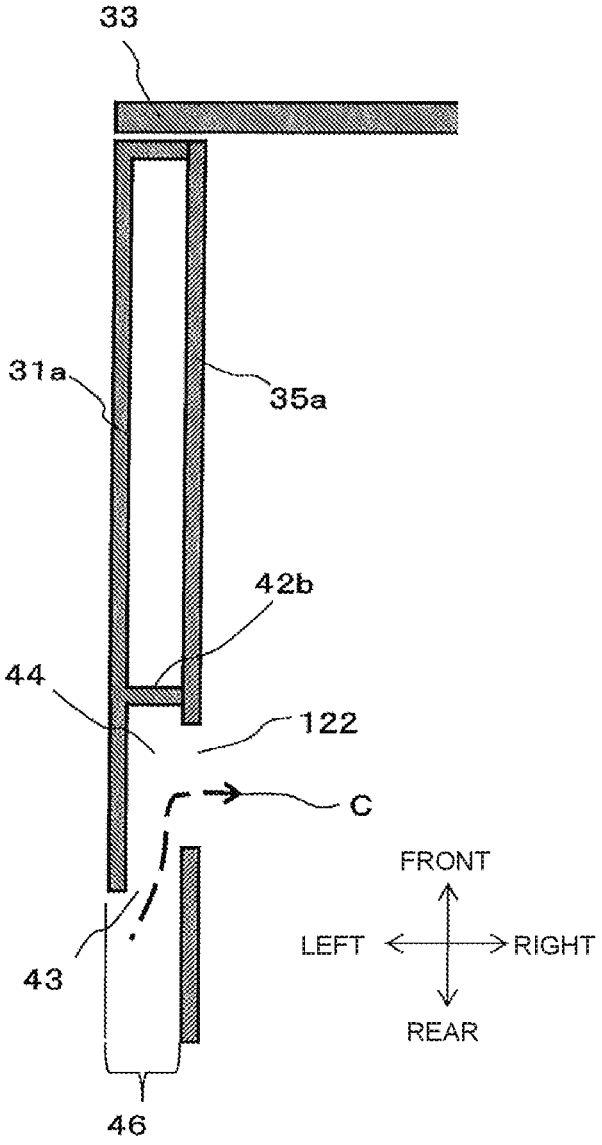
FIG. 11 is a view for illustrating the indoor unit in which a positional relationship between the ventilation hole and an air intake port is changed from FIG. 10.

FIG. 11 is a view for illustrating the indoor unit 100 in which the positional relationship between the ventilation hole 22 and the air intake port 43 is changed from FIG. 10. As illustrated in FIG. 10 and FIG. 11, the airflow C, in which the air flowing through the air intake port 43 is caused to flow, has an L-shape. In FIG. 11, a ventilation hole 122 is arranged on a far side away from the air intake port 43. Further, an indoor unit front surface side end portion of the ventilation hole 22 is positioned on an indoor unit rear surface side with respect to the flow passage wall 42*b*, which is arranged on the indoor unit front surface side of the airflow passage 44. Meanwhile, in FIG. 10, an indoor unit rear surface-side end portion of the ventilation hole 22 is arranged at the same position as the opening of the air intake port 43 in forward and backward directions of the indoor unit 100. An indoor unit front surface side end portion of the ventilation hole 22 is arranged at the same position as the wall surface of the flow passage wall 42*b*. That is, the ventilation hole 22 is surrounded by the base portion 40 of the side panel 31*a* and the flow passage walls 42*a* to 42*c* to form the airflow passage 44. With this structure, the air, which is caused to flow through the air intake port 43, can be caused to flow from the ventilation hole 22 to the room temperature sensor 50 without being diffused between the side panel 31*a* and the housing side portion 35*a*.

A sub-air passage is formed between the ventilation hole 22 and the main air passage 10. When the air-sending device 14 on the main air passage 10 operates, not only the air flowing through the air inlet 11 but also the air present in the sub-air passage is taken into the main air passage 10. When the air present in the sub-air passage is taken into the main air passage 10, the indoor air is also caused to flow into the air intake port 43. Through arrangement of the room temperature sensor 50 in the middle of this airflow, the room temperature is detected. The room temperature sensor 50 is arranged on the air intake port 43 side, thereby being capable of precisely detecting the room temperature without being affected by the temperature inside the indoor unit 100. That is, the airflow, which is introduced through the air intake port 43 into the indoor unit 100, is caused to flow from the air intake port 43 via the airflow passage 44, the ventilation hole 22, and the sub-air passage into the main air passage 10. On the sub-air passage, the room temperature sensor 50 is arranged on upstream, and the electric component box 20 is arranged on downstream. A temperature of the air flowing in the sub-air passage is detected by the room temperature sensor 50 on the upstream of the sub-air passage. After the air passes through the room temperature sensor 50, the air is introduced into the main air passage 10 while cooling the electric component box 20.

Further, the air flowing through the airflow passage 44, exchanges heat with the side panel 31*a* and the housing side portion 35*a*. Thus, when a length from the air intake port 43 to the ventilation hole 22 is large, the air temperature changes in the airflow passage 44, with the result that the room temperature sensor 50 cannot precisely detect the room temperature. Therefore, it is desired that the length from the air intake port 43 to the room temperature sensor 50 be set to small. That is, as illustrated in FIG. 10, it is desired that the indoor unit rear surface-side end portion of the ventilation hole 22 be positioned at the same position as the opening of the air intake port 43 in the forward and backward directions of the indoor unit 100. That is, with the above-mentioned structure, a distance from the air intake port 43 to the ventilation hole 22 is minimum, and the ventilation hole 22, which is opened toward a side direction of the indoor unit 100, is covered with the side panel 31. Accordingly, the indoor unit 100 can precisely detect the room temperature, and a hole for detection of the room temperature is not formed in the side of the indoor unit 100, with the result that an outer appearance design is not affected.

In Embodiment 1, description is made of the structure in which the room temperature sensor 50 is arranged on the side surface on the right side of the indoor unit 100 as viewed from the front. However, the arrangement of the temperature sensor 50 is not limited to the right side of the indoor unit 100. Through application of the same structure as in Embodiment 1 to the side surface on the left side of the indoor unit 100, the same effect can be obtained as in the case where the room temperature sensor 50 is arranged on the side surface on the right side.

Embodiment 2

In Embodiment 2 of the present invention, the structure of the side panel 31*a* is changed from Embodiment 1. In Embodiment 2, description is mainly made of changes from Embodiment 1. Portions having the same structures as those of the indoor unit 100 for an air-conditioning apparatus of Embodiment 1 are denoted by the same reference symbols, and description thereof is omitted.

Figure 12:
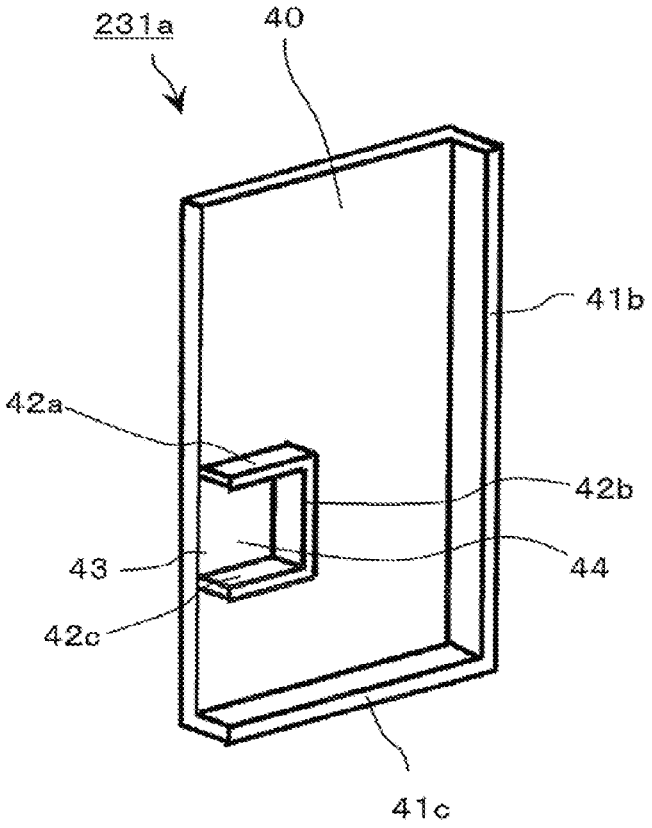
FIG. 12 is a perspective view for illustrating a side panel on a right side of an indoor unit according to Embodiment 2 of the present invention as viewed from a back side.

FIG. 12 is a perspective view for illustrating a side panel 231*a* on the right side of an indoor unit 200 according to Embodiment 2 of the present invention as viewed from a back side. As compared to the indoor unit 100 according to Embodiment 1, the indoor unit 200 has the side panel 31*a* and the housing side portion 35*a*, which have different structures. The side panel 231*a* according to Embodiment 2 has the outer peripheral walls 41*b* and 41*c* extending upright from the outer edge portion of the base portion 40 in the normal direction of the base portion 40. That is, in Embodiment 1, the side panel 231*a* does not have the outer peripheral wall 41*a* on the top surface side and the outer peripheral wall 41*d* on the rear surface side. The side panel 231*a* does not have the outer peripheral wall 41*a* on the top surface side and the outer peripheral wall 41*d* on the rear surface side. However, an outer appearance design of the indoor unit 200 is not affected because the outer peripheral walls 41, which are less liable to be visually recognized by a user of the indoor unit 200, are not arranged. The indoor unit 200, which includes the side panel 231*a* having such a structure, does not have the outer peripheral walls 41. Accordingly, an amount of resin required for molding the side panel 231*a* can be reduced, thereby being capable of reducing the cost.

The side panel 231*a* has the flow passage walls 42*a* to 42*c*. The airflow passage 44, which is surrounded by the flow passage walls 42*a* to 42*c* and the base portion 40, is formed so as to cover the ventilation hole 22 formed in the housing side portion 35*a* from the side surface side. The flow passage walls 42*a* to 42*c*, which form the airflow passage 44, are arranged so as to surround the vicinity of the opening of the ventilation hole 22 from three directions. The side panel 231*a* does not have the outer peripheral wall 41*d* on the rear surface side, and have such structure that the flow passage wall 42*a* and the flow passage wall 42*c* extend from the outer edge portion of the base portion 40 toward the inner side of the base portion 40. The air intake port 43 is formed of an end surface of the flow passage wall 42*a* positioned on the outer edge side of the base portion 40, an end surface of the flow passage wall 42*c* positioned on the outer edge side of the base portion 40, and an end surface of the base portion 40. With such structure, the passage for introducing the indoor air to the room temperature sensor 50 has the same structure as that of Embodiment 1. Thus, also in Embodiment 2, the indoor air is caused to flow into the housing 30 as indicated by the airflow C of FIG. 10.

Figure 13:
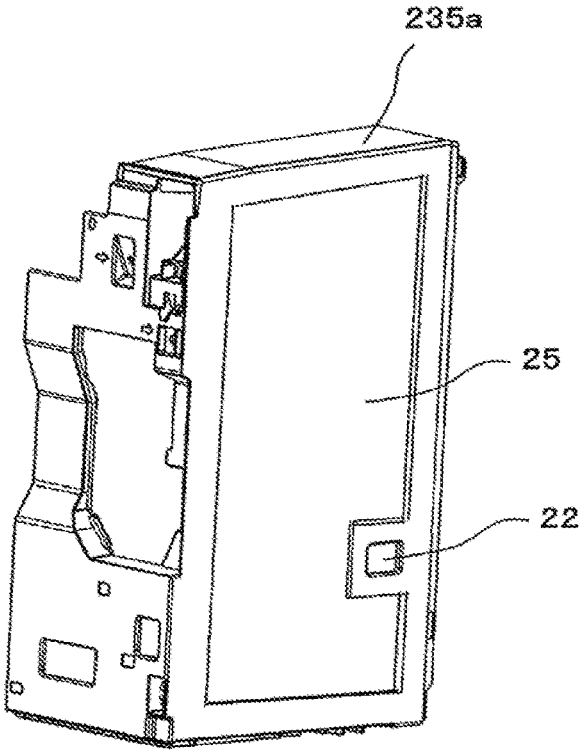
FIG. 13 is a perspective view for illustrating a housing side portion on the right side of the indoor unit according to Embodiment 2 of the present invention.

FIG. 13 is a perspective view for illustrating a housing side portion 235*a* on the right side of the indoor unit 200 according to Embodiment 2 of the present invention. As illustrated in FIG. 13, in the housing side portion 235*a*, a hole 25 may be formed in a surface covered with the side panel 231*a*. The hole 25 is formed in a surface other than a part of the surface, which forms the airflow passage 44 by being held in contact with the flow passage walls 42*a* to 42*c* arranged on the side panel 231*a* surrounding the ventilation hole 22. With such structure, in a part from the air intake port 43 to the ventilation hole 22, the airflow C (see FIG. 10 and FIG. 11) for introducing the indoor air to the room temperature sensor 50 as in Embodiment 1 is formed. Meanwhile, the openings on the top surface side and the rear surface side, in which the outer peripheral walls 41 of the side panel 231*a* are not arranged, serve as openings for introducing the air to the hole 25. Through combination of the side panel 231*a* and the housing side portion 235*a*, a space is formed between the base portion 40 and the housing side portion 235*a*. The space serves as a passage for introducing the air to the hole 25. With the above-mentioned structure, an area of an air inlet for taking the air into the indoor unit 200 is enlarged so that a pressure loss of the air to be taken in is reduced, with the result that a blowing performance is improved. Further, similarly to Embodiment 1, an introduction passage for the air to the room temperature sensor 50 is independently secured, thereby being capable of precisely detecting the room temperature. In the above-mentioned description, description is made of the side panel 231*a* and the housing side portion 235*a*, which are positioned on the right side of the indoor unit 200. However, on the left side of the indoor unit 200, the side panel 31*b* may be constructed such that the outer peripheral walls 41 are not arranged on the top surface side and the rear surface side similarly to the side panel 231*a*, and the hole 25 may be formed in the housing side portion 35*b* similarly to the housing side portion 235*a*. Through employment of such structure to the right and left sides of the indoor unit 200, the blowing performance of the indoor unit 200 is further improved.

Embodiment 3

In Embodiment 3 of the present invention, the structure of the side panel 31*a* is changed from Embodiment 1. In Embodiment 3, description is mainly made of changes from Embodiment 1. The portions having the same structures as in the indoor unit 100 for an air-conditioning apparatus of Embodiment 1 are denoted by the same reference symbols, and the description thereof is omitted.

Figure 14:
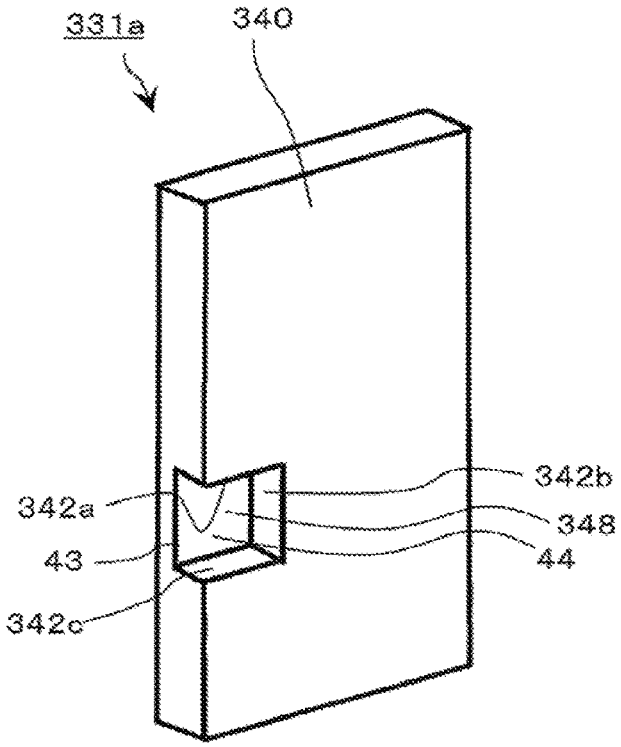
FIG. 14 is a perspective view for illustrating a side panel on a right side of an indoor unit according to Embodiment 3 of the present invention as viewed from a back side.

FIG. 14 is a perspective view for illustrating a side panel 331*a* on the right side of an indoor unit 300 according to Embodiment 3 of the present invention as viewed from a back side. In the indoor unit 300, the side panel 31*a* is changed from the indoor unit 100 according to Embodiment 1, and the remaining structure is the same as that of the indoor unit 100 according to Embodiment 1. The side panel 331*a* need not have the hollow structure in which the flow passage walls 42*a* to 42*c* are arranged as in the side panel 31*a* according to Embodiment 1. As illustrated in FIG. 14, a recessed portion 348 is formed at a part of a plate portion 340. Perpendicular walls, which are formed through formation of the recessed portion 348, may serve as flow passage walls 342*a* to 342*c*. The flow passage walls 342 need not be perpendicular to a surface of a flat plate portion of the plate portion 340, that is, a surface to be a side surface in an outer appearance of the indoor unit 300. The flow passage walls 342 may be inclined with respect thereto.

Figure 15:
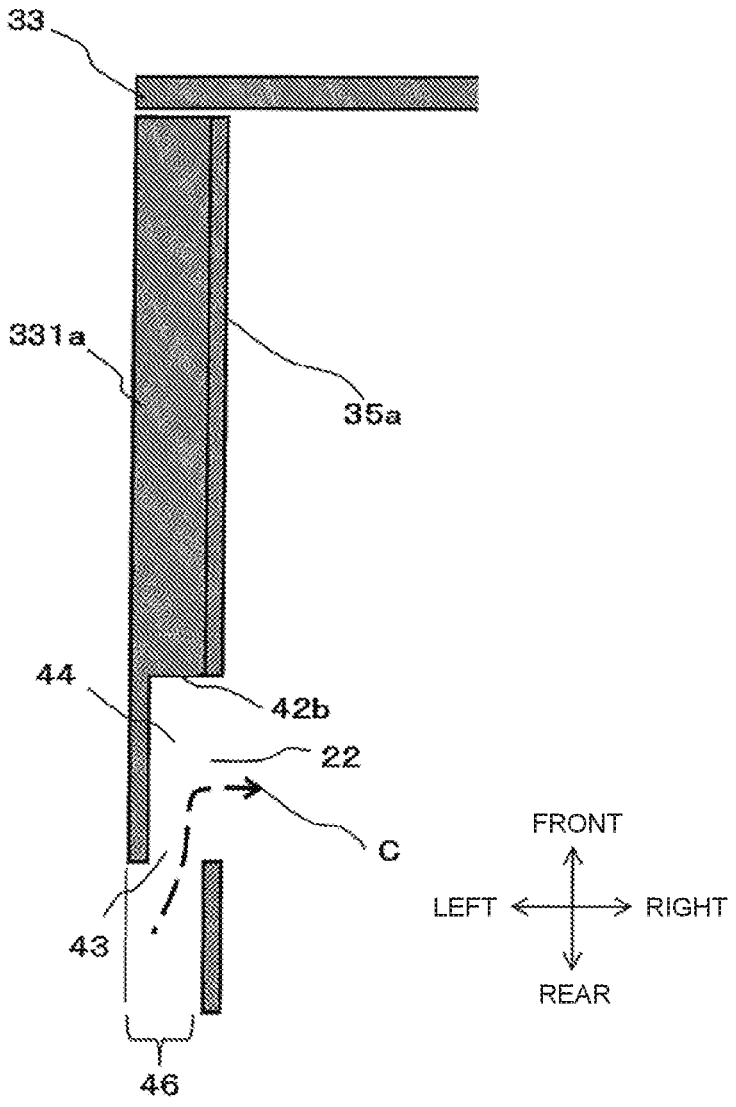
FIG. 15 is a sectional view for illustrating the indoor unit according to Embodiment 3 of the present invention taken along the line B-B of FIG. 1.

FIG. 15 is a sectional view for illustrating the indoor unit according to Embodiment 3 of the present invention taken along the line B-B of FIG. 1. The recessed portion 348 covers the ventilation hole 22 formed in the housing side portion 35*a* from the side surface side of the indoor unit 300 to form the airflow passage 44. An opening portion of the recessed portion 348, which is oriented toward a rear surface side of the indoor unit 300, serves as the air intake port 43. With such structure, the passage for introducing the indoor air to the room temperature sensor 50 has the same structure as in Embodiment 1. Accordingly, also in Embodiment 3, the indoor air is caused to flow into the housing 30 as indicated by the airflow C of FIG. 10.

Also in such structure, the indoor air is caused to flow into the housing 30 as in Embodiment 1. Thus, the structure of the side panel 31*a* of the indoor unit 100 according to Embodiment 1 can be changed while obtaining the same effect as in Embodiment 1.

Embodiment 4

In Embodiment 4 of the present invention, the structure of the housing side portion 35*a* is changed from Embodiment 1. In Embodiment 4, description is mainly made of changes from Embodiment 1. The portions having the same structures as in the indoor unit 100 for an air-conditioning apparatus of Embodiment 1 are denoted by the same reference symbols, and the description thereof is omitted.

Figure 16:
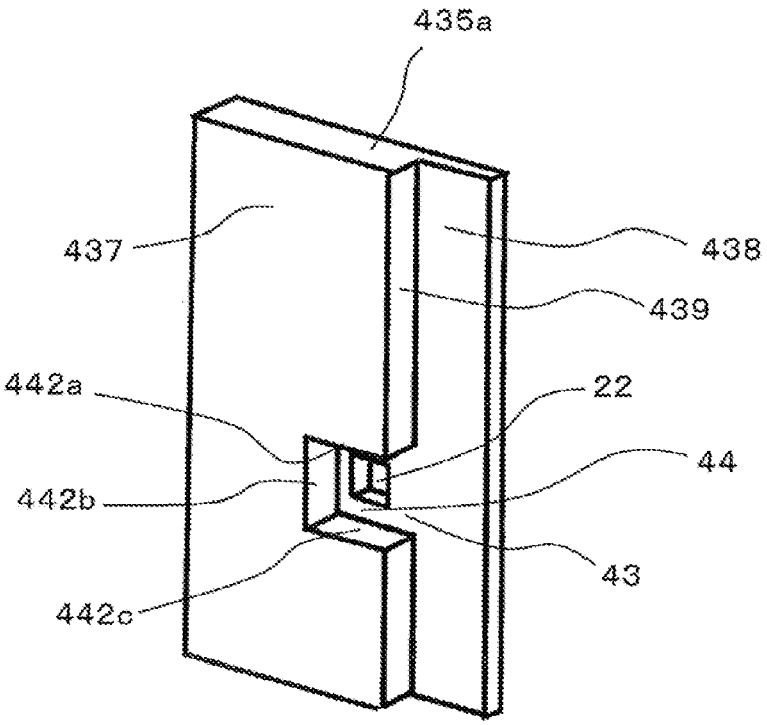
FIG. 16 is a perspective view for illustrating a housing side portion on a right side of the indoor unit according to Embodiment 4 of the present invention.

FIG. 16 is a perspective view for illustrating a housing side portion 435*a* on the right side of the indoor unit 400 according to Embodiment 4 of the present invention. FIG. 16 is a schematic view for mainly illustrating a surface in which the ventilation hole 22 of the housing side portion 35*a* of FIG. 6 is formed. In the indoor unit 400, the side panel 31*a* and the housing side portion 35*a* are changed from the indoor unit 100 according to Embodiment 1, and the remaining structure is the same as that of the indoor unit 100 according to Embodiment 1. In Embodiment 4, as illustrated in FIG. 16, a step is formed in the housing side portion 435*a*. A stepped surface 439 is formed so as to be oriented toward a rear surface side of the indoor unit 400. The housing side portion 435*a* has a surface 438 and a surface 437. The surface 438 has the ventilation hole 22 formed therein. The surface 437 is away from the surface 438 by a predetermined distance, for example, by 5 mm in Embodiment 4 in a sideward direction of the indoor unit 400. Specifically, a step having a dimension of 5 mm is formed between the surface 438 and the surface 437. Only a peripheral portion of the ventilation hole 22 in the surface 437 is recessed. Walls are arranged perpendicular to the surface 438 so as to surround the ventilation hole 22, with the result that the flow passage walls 442*a* to 442*c* are formed. The flow passage walls 442 need not be perpendicular to the surface 438 in which the ventilation hole 22 is formed. The flow passage walls 442 may be inclined with respect thereto.

Figure 17:
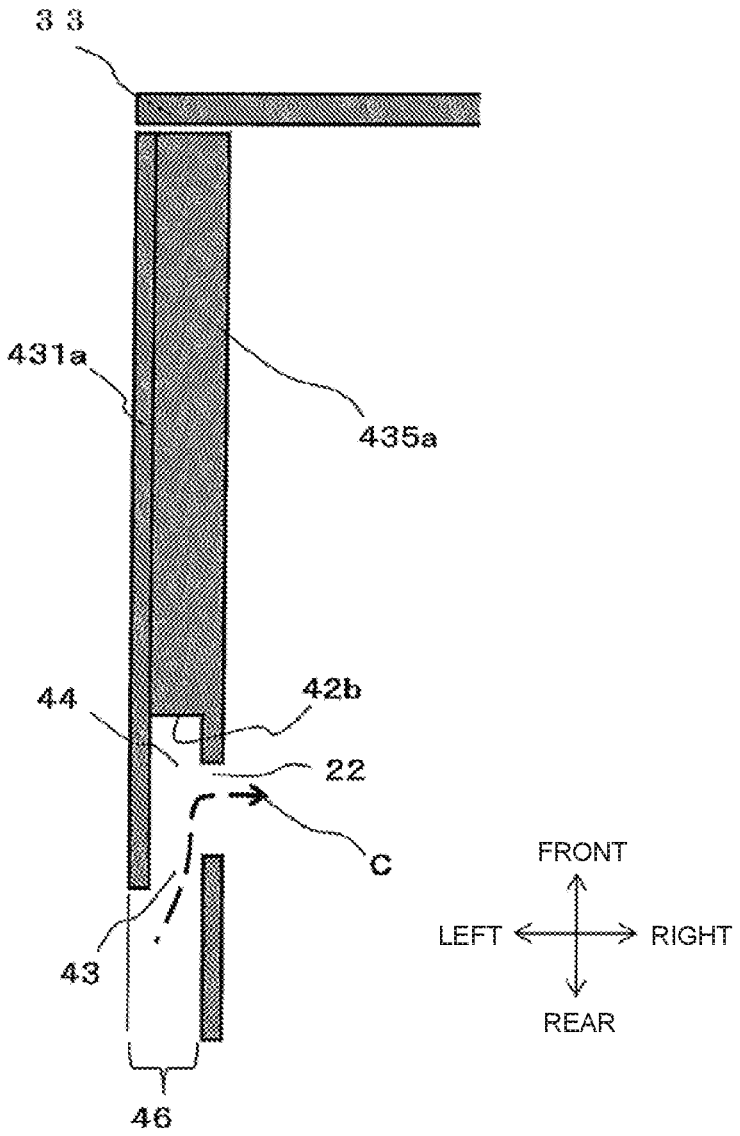
FIG. 17 is a sectional view for illustrating the indoor unit according to Embodiment 4 of the present invention taken along the line B-B of FIG. 1.

FIG. 17 is a sectional view for illustrating the indoor unit 400 according to Embodiment 4 of the present invention taken along the line B-B of FIG. 1. A side panel 431*a* is mounted to the surface 437 as illustrated in FIG. 16. The side panel 431*a* has a flat plate shape, and forms the airflow passage 44 by covering the flow passage walls 442, which surround the ventilation hole 22 formed in the housing side portion 435*a*. An opening portion of the flow passage walls 442, which surrounds the ventilation hole 22 being oriented toward a rear surface side of the indoor unit 400, serves as the air intake port 43. With such structure, the passage for introducing the indoor air to the room temperature sensor 50 has the same structure as in Embodiment 1. Accordingly, also in Embodiment 4, the indoor air is caused to flow into the housing 30 as indicated by the airflow C of FIG. 10.

Also in such structure, the indoor air is caused to flow into the housing 30 as in Embodiment 1. Thus, the structure of the housing side portion 35*a* of the indoor unit 100 according to Embodiment 1 can be changed while obtaining the same effect as in Embodiment 1. In the housing side portion 435*a*, the surface 437 illustrated in FIG. 16 may be formed into a box shape by removing a thick portion thereinside. Even when the surface 437 is formed into a box shape, in a case where the flow passage walls 442*a* to 442*c* surrounding the ventilation hole 22 are arranged, the airflow passage 44 and the air intake port 43 are formed by being covered with the side panel 431*a*.

In Embodiments 1 to 4, the position of the opening of the air intake port 43 is not limited to the rear surface side, and may be the top surface side, the lower surface side, and the front surface side. The airflow passage 44 and the flow passage walls 42, 242, 342, and 442 forming the airflow passage 44 may also be changed in orientation in accordance with the surface forming the air intake port 43. However, in order to efficiently take the indoor air into the indoor unit, it is advantageous to have the structure, in which the air intake port 43 is formed on the rear surface side of the indoor unit, as described in Embodiments 1 to 4 of the present invention. For example, when the air intake port 43 is formed in the upper surface, dust is liable to enter through the air intake port 43. When the air intake port 43 is formed in the bottom surface and the front surface, the air intake port 43 is liable to be visually recognized by the user after installation of the indoor unit in the room. However, even with such structures, the airflow passage is formed as in Embodiments 1 to 4, thereby being capable of detecting a temperature of the indoor air.

<Effects of Present Invention>

The indoor units 100, 200, 300, and 400 for an air-conditioning apparatus according to Embodiments 1 to 4 of the present invention include the housing 30 having the rear surface mounted to the wall and having the air inlet 11 and the air outlet 12 which are formed in the housing 30, the heat exchanger 13 and the air-sending device 14 which are arranged on the main air passage 10 extending from the air inlet 11 to the air outlet 12, and the room temperature sensor 50 configured to detect a temperature of the intake air. The housing 30 has the air intake port 43 for intake of the air to be sent to the room temperature sensor 50 in the side surface adjacent to the rear surface. The room temperature sensor 50 is arranged on an air passage connecting the air intake port 43 and the main air passage 10, and the air intake port 43 is opened toward the rear surface side.

With such structure, the indoor units 100, 200, 300, and 400 for an air-conditioning apparatus can take in the indoor air to be sent to the room temperature sensor 50 through the air intake port 43 positioned at a position which is less liable to be visually recognized by the user. The air intake port 43 is formed at the position which is less liable to be visually recognized by the user, and hence the area of the opening of the air intake port 43 can freely be set. Thus, the indoor units 100, 200, 300, and 400 can precisely detect the room temperature, and the air intake port 43 can be formed without affecting the outer appearance design.

In the indoor units 100, 200, 300, and 400 for an air-conditioning apparatus according to Embodiments 1 to 4 of the present invention, the side surface of the housing 30 has the stepped surface 45 formed between the first surface 38 positioned on the outer side of the housing 30 and the second surface 39 positioned away from the first surface 38 in the inner direction of the housing 30. The stepped surface 45 is oriented toward the rear surface side of the housing 30. The stepped surface 45 has the recessed portion opened toward the rear surface side. The air intake port 43 serves as the opening portion of the recessed portion.

With such structure, in addition to the above-mentioned effect, in the indoor units 100, 200, 300, and 400, the air intake port 43 can be formed in the housing 30 with high space efficiency.

The indoor units 100, 200, 300, and 400 for an air-conditioning apparatus according to Embodiments 1 to 4 of the present invention comprises the ventilation hole 22 being formed in the recessed portion and communicating to the inside of the housing 30. An airflow passage 44 extends from the air intake port 43 via the recessed portion and the ventilation hole 22 to the room temperature sensor 50.

With such structure, in addition to the above-mentioned effects, the indoor units 100, 200, 300, and 400 can prevent the air, which is to be introduced to the room temperature sensor, from being thermally affected in the housing 30.

The housing 30 of the indoor units 100, 200, 300, and 400 for an air-conditioning apparatus according to Embodiments 1 to 4 of the present invention comprises the housing side portion 35*a* being a structure on the side surface side of the housing, and the side panel 31*a* for covering the housing side portion 35*a*. The housing side portion 35*a* has the second surface 39 and the ventilation hole 22. The side panel 31 has the first surface 38 and is mounted to the housing side portion 35*a* to form the stepped surface 45. Further, the recessed portion has the flow passage walls 42 extending upright so as to surround the ventilation hole 22. The flow passage walls 42 are opened on the rear surface side of the housing 30. The side panel 31*a* has the base portion 40 having the first surface 38 on the outer side of the housing 30, and the outer peripheral walls 41 extending upright from the outer edge portion of the base portion 40. The airflow passage 44 is formed of the ventilation hole 22, the surface having the ventilation hole 22 formed therein, the flow passage walls 42, and the base portion 40. Further, the flow passage walls 42 extend upright from the housing side portion 35*a* or from the base portion of the side panel 31*a*.

With such structure, in addition to the above-mentioned effects, the indoor units 100, 200, 300, and 400 can be manufactured while suppressing the material cost by forming the side panel 31 or the housing side portion 35*a*, which is a component constructing the housing 30, into a hollow structure.

The room temperature sensor 50 of the indoor units 100, 200, 300, and 400 for an air-conditioning apparatus according to Embodiments 1 to 4 of the present invention is arranged on the sub-air passage connecting the ventilation hole 22 and the main air passage 10. Further, the indoor units 100, 200, 300, and 400 further include the electric component box 20 for accommodating a control board configured to control the indoor unit. The electric component box 20 is arranged on the sub-air passage. The room temperature sensor 50 is arranged below the electric component box 20.

With such structure, in the indoor units 100, 200, 300, and 400, the indoor air is introduced to the room temperature sensor 50 along with the operation of the air-conditioning apparatus so that the room temperature is detected. Meanwhile, the air after being subjected to measurement of the room temperature can cool the internal structure such as the electric component box 20. With this structure, the room temperature sensor 50 can detect the temperature while suppressing a temperature effect from the electric component box 20.

REFERENCE SIGNS LIST

10 main air passage 11 air inlet 12 air outlet 13 heat exchanger

14 air-sending device 15 horizontal vane 16 vertical vane 20 electric component box 22 ventilation hole 25 hole 26 surface 30 housing 31 side panel 31*a* side panel 31*b* side panel 32 upper panel

33 front panel 33*a* housing side portion 34 rear casing 35*a* housing side portion 35*b* housing side portion 36 housing front portion 37 housing bottom portion 38 first surface 39 second surface 40 base portion

41 outer peripheral wall 41*a* outer peripheral wall 41*b* outer peripheral wall 41*c* outer peripheral wall 41*d* outer peripheral wall 42 flow passage wall 42*a* flow passage wall 42*b* flow passage wall 42*c* flow passage wall 43 air intake port 44 airflow passage 45 stepped surface

46 step 50 room temperature sensor 100 indoor unit 200 indoor unit

231*a* side panel 235*a* housing side portion 242 flow passage wall 300 indoor unit 331*a* side panel 340 plate portion 342 flow passage wall 342*a* flow passage wall 342*b* flow passage wall 342*c* flow passage wall 348 recessed portion 400 indoor unit 431*a* side panel 435*a* housing side portion 437 surface 438 surface 439 stepped surface 442 flow passage wall

442*a* flow passage wall 442*b* flow passage wall 442*c* flow passage wall A room temperature sensor peripheral portion C airflow

The invention claimed is:

1. An indoor unit for an air-conditioning apparatus, comprising:

a housing having a rear surface mounted to a wall and having an air inlet and an air outlet formed therein;

a heat exchanger and an air-sending fan arranged on a main air passage extending from the air inlet to the air outlet; and a room temperature sensor configured to detect a temperature of intake air, wherein a side surface of the housing has a first surface positioned on an outer side of the housing, a second surface positioned away from the first surface in an inner direction of the housing, and a stepped surface, perpendicular to the first surface and the second surface, formed between the first surface and the second surface, and is oriented toward a rear surface side of the housing, wherein the stepped surface has an air intake port formed therein from which air to be sent to the room temperature sensor is allowed to be taken opened toward the rear surface side, and wherein the room temperature sensor is arranged on an air passage connecting the air intake port and the main air passage.

2. An indoor unit for an air-conditioning apparatus, comprising:

a housing having a rear surface mounted to a wall and having an air inlet and an air outlet formed therein;

a heat exchanger and an air-sending fan arranged on a main air passage extending from the air inlet to the air outlet; and a room temperature sensor configured to detect a temperature of intake air, wherein a side surface of the housing has a first surface positioned on an outer side of the housing, a second surface positioned away from the first surface in an inner direction of the housing, and a stepped surface formed between the first surface and the second surface, and is oriented toward a rear surface side of the housing, wherein the stepped surface has an air intake port from which air to be sent to the room temperature sensor is allowed to be taken opened toward the rear surface side, and wherein the room temperature sensor is arranged on an air passage connecting the air intake port and the main air passage.

3. An indoor unit for an air-conditioning apparatus, comprising:

a housing having a rear surface mounted to a wall and having an air inlet and an air outlet formed therein;

a heat exchanger and an air-sending fan arranged on a main air passage extending from the air inlet to the air outlet; and a room temperature sensor configured to detect a temperature of intake air, wherein a side surface of the housing has a first surface positioned on an outer side of the housing, a second surface positioned away from the first surface in an inner direction of the housing, and a stepped surface formed between the first surface and the second surface, and is oriented toward a rear surface side of the housing, wherein the stepped surface has an air intake port from which air to be sent to the room temperature sensor is allowed to be taken opened toward the rear surface side, and wherein the room temperature sensor is arranged on an air passage connecting the air intake port and the main air passage, wherein, the stepped surface includes a recessed portion having the air intake port as an opening portion, the indoor unit further comprising;

a ventilation hole formed in the recessed portion and communicating to an inside of the housing; and an airflow passage extending from the air intake port via the recessed portion to the ventilation hole.

4. The indoor unit for an air-conditioning apparatus of claim 3, wherein the housing has a housing side portion being a structure on a side surface side of the housing, and a side panel covering the housing side portion, wherein the housing side portion has the second surface and the ventilation hole opened on the second surface, and wherein the side panel has the first surface and is mounted to the housing side portion to form the stepped surface.

5. The indoor unit for an air-conditioning apparatus of claim 4, wherein the recessed portion has flow passage walls extending upright so as to surround the ventilation hole, wherein the flow passage walls are opened toward the rear surface side of the housing, wherein the side panel has a base portion having the first surface on an outer side of the housing, and wherein the airflow passage is formed of the ventilation hole, the second surface, the flow passage walls, and the base portion.

6. The indoor unit for an air-conditioning apparatus of claim 5, wherein the flow passage walls extend upright from the housing side portion.

7. The indoor unit for an air-conditioning apparatus of claim 5, wherein the flow passage walls extend upright from the base portion of the side panel.

8. The indoor unit for an air-conditioning apparatus of claim 7, wherein the side panel further includes an outer peripheral wall extending upright from an outer edge portion of the base portion, wherein the outer peripheral wall is cut out a portion thereof and the air intake port is formed thereby, and wherein the flow passage walls extend in an inner direction from the outer edge portion of the base portion, and form a rectangular shape with the air intake port as an inlet side.

9. The indoor unit for an air-conditioning apparatus of claim 3, wherein the room temperature sensor is arranged on a sub-air passage connecting the ventilation hole and the main air passage.

10. The indoor unit for an air-conditioning apparatus of claim 9, further comprising an electric component box accommodating a control board configured to control the indoor unit, wherein the electric component box is arranged on the sub-air passage, and wherein the room temperature sensor is arranged below the electric component box.

* * * * *